US009534789B2

(12) United States Patent
Scarinci

(10) Patent No.: US 9,534,789 B2
(45) Date of Patent: Jan. 3, 2017

(54) TWO-BRANCH MIXING PASSAGE AND METHOD TO CONTROL COMBUSTOR PULSATIONS

(71) Applicant: INDUSTRIAL TURBINE COMPANY (UK) LIMITED

(72) Inventor: Thomas Scarinci, Mont-Royal (CA)

(73) Assignee: INDUSTRIAL TURBINE COMPANY (UK) LIMITED (GB)

( * ) Notice: Subject to any disclaimer, the term of this patent is extended or adjusted under 35 U.S.C. 154(b) by 263 days.

(21) Appl. No.: 14/274,647

(22) Filed: May 9, 2014

(65) Prior Publication Data

US 2014/0283525 A1 Sep. 25, 2014

Related U.S. Application Data

(63) Continuation of application No. 11/257,264, filed on Oct. 24, 2005, now abandoned.

(51) Int. Cl.

| | |
|---|---|
| ***F23R 3/34*** | (2006.01) |
| ***F23R 3/28*** | (2006.01) |
| ***F23M 20/00*** | (2014.01) |

(52) U.S. Cl.

CPC ..... *F23R 3/34* (2013.01); *F23M 20/005* (2015.01); *F23R 3/286* (2013.01); *F23R 2900/00014* (2013.01)

(58) Field of Classification Search

CPC ..... F23R 3/346; F23R 3/34; F23R 3/286; F23R 2900/00014; F23R 2900/00013; F02C 7/24; F02C 7/222;F02C 9/26; F02C 9/34; F23M 20/005

See application file for complete search history.

(56) References Cited

U.S. PATENT DOCUMENTS

| | | | | |
|---|---|---|---|---|
| 3,055,179 | A | 9/1962 | Lefebvre et al. | |
| 4,955,191 | A * | 9/1990 | Okamoto | F02C 3/30 60/39.3 |
| 5,323,614 | A | 6/1994 | Tsukahara et al. | |
| 5,361,586 | A | 11/1994 | McWhirter et al. | |
| 5,450,725 | A | 9/1995 | Takahara et al. | |
| 5,596,873 | A | 1/1997 | Joshi et al. | |
| 5,713,206 | A | 2/1998 | McWhirter et al. | |
| 5,797,267 | A | 8/1998 | Richards | |
| 6,052,986 | A | 4/2000 | Hoffmann et al. | |
| 6,253,555 | B1 | 7/2001 | Willis | |
| 6,272,842 | B1 | 8/2001 | Dean | |
| 6,332,313 | B1 | 12/2001 | Willis et al. | |
| 6,412,282 | B1 | 7/2002 | Willis | |
| 6,513,334 | B2 | 2/2003 | Varney | |

(Continued)

OTHER PUBLICATIONS

Lieuwen et al, A Mechanism for Combustion Instabilities in Premixed Gas Turbine Combustors, Journal of Engineering for Gas Turbines and Power, vol. 123 (1), pp. 182-190 (2001).

(Continued)

*Primary Examiner* — Andrew Nguyen

(74) *Attorney, Agent, or Firm* — Beusse Wolter Sanks & Maire

(57) ABSTRACT

A gas turbine engine combustion system including a mixing duct that separates into at least two branch passages for the delivery of a fuel and working fluid to distinct locations within a combustion chamber. The residence time for the fuel and working fluid within each of the two branch passages is distinct.

18 Claims, 6 Drawing Sheets

(56) References Cited

U.S. PATENT DOCUMENTS

| | | | |
|---|---|---|---|
| 6,532,742 | B2 | 3/2003 | Scarinci et al. |
| 6,698,206 | B2 | 3/2004 | Scarinci et al. |
| 2002/0020173 | A1 | 2/2002 | Varney |
| 2002/0134086 | A1 | 9/2002 | Doebbeling et al. |
| 2003/0150216 | A1 | 8/2003 | O'Beck et al. |
| 2003/0221431 | A1 | 12/2003 | Rock |

OTHER PUBLICATIONS

Lieuwen et al, The Role of Equivalence Ratio Oscillations in Driving Combustion Instabilities in Low Nox Gas Turbines, Proceedings of 27th Symposium (International) on Combustion, The Combustion Institute, pp. 1809-1816 (1998).

* cited by examiner

TWO-BRANCH MIXING PASSAGE AND METHOD TO CONTROL COMBUSTOR PULSATIONS

CROSS-REFERENCE TO RELATED APPLICATIONS

The present application is a continuation of U.S. patent application Ser. No. 11/257,264, filed Oct. 24, 2005, the contents of which are incorporated herein by reference.

FIELD OF THE INVENTION

The present invention relates generally to gas turbine engine combustion systems. More particularly, in one form the present invention relates to a combustion system including a mixing duct separated into two branches for the discharge of a fuel and working fluid mixture into distinct locations within the combustion chamber.

BACKGROUND

A gas turbine engine is typical of the type of turbomachinery in which the present application may be utilized. It is well known that a gas turbine engine conventionally comprises a compressor for compressing inlet air to an increased pressure for combustion in a combustion chamber. A mixture of fuel and the increased pressure air is burned in the combustion chamber to generate a high temperature gaseous flow stream for causing rotation of turbine blades within the turbine. The turbine blades convert the energy from the high temperature gaseous flow stream into kinetic energy that may be utilized for example to turn an electric generator, pump or other mechanically driven device. Further, the high temperature gaseous flow stream may be used as a heat source to produce steam or provide energy for chemical processing.

Many gas turbine engines are equipped with lean premix combustor technology that mixes the fuel and air together prior to delivery to the combustion chamber. Lean premix technology has been applied primarily to industrial gas turbine engines to control and reduce flame temperatures. The control and reduction of flame temperatures is one way in which lower levels of air pollutants such as $NO_x$ and CO are obtained. However, some prior art lean premix combustors are susceptible to destructive pressure pulsations that can adversely impact the system integrity. In many cases the pressure pulsations can originate from temporal fluctuations in the fuel and air mixture strength introduced in the burning zone of the combustor.

Thus a need remains for further contribution in the area of combustor technology. The present application satisfies this and other needs in a novel and nonobvious way.

SUMMARY

One form of the present application contemplates a gas turbine engine combustor, comprising: a combustion chamber; a duct having a working fluid therein; a fuel delivery device in fluid communication with the duct, the fuel delivery device introduces a fuel to the working fluid within the duct to define a fuel and working fluid mixture; a first branch duct routing a first portion of the fuel and working fluid mixture from the duct to a first location at the combustion chamber; a second branch duct routing a second portion of the fuel and working fluid mixture from the duct to a second location at the combustion chamber; and wherein the travel time of the first portion of the fuel and working fluid mixture to the first location is different from the travel time of the second portion of the fuel and working fluid mixture to the second location.

Another form of the present application contemplates a method comprising: increasing the pressure of a working fluid within a compressor of a gas turbine engine; introducing a fuel into the working fluid after the increasing to define a fuel and working fluid mixture; separating the fuel and working fluid mixture into at least two distinct and separate fuel and working fluid mixture streams; and delivering one of the at least two distinct and separate fuel and working fluid mixture streams to a first location within a combustion chamber and another of the at least two distinct and separate fuel and working fluid mixture streams to a second location within the combustion chamber, wherein the time to deliver the fuel and working fluid mixture stream to the first location is different than the time to deliver the fuel and working fluid mixture stream to the second location.

In yet another form the present application contemplates a gas turbine engine combustor for burning a fuel and air mixture, comprising: a combustion chamber; a first mixing duct; a first fuel delivery device in fluid communication with the first mixing duct, the first fuel delivery device introduces fuel to the air within the first mixing duct to define a first fuel and air mixture; a second mixing duct with working fluid therein, the second mixing duct forming an annular passage around at least a portion of the combustion chamber; a second fuel delivery device in fluid communication with the second mixing duct, the second fuel delivery device introduces fuel to the air within the second mixing duct to define a second fuel and air mixture; a first branch duct in flow communication with the second mixing duct, the first branch duct receiving and routing a portion of the second fuel and air mixture to a first location at the combustion chamber; a second branch duct in flow communication with the second mixing duct, the second branch duct receiving and routing another portion of the second fuel and air mixture to a second location at the combustion chamber, the second location is spaced downstream from the first location; and wherein the residence time of the portion of the second fuel and air mixture within the first branch duct is not equal to the residence time of the another portion of the second fuel and air mixture within the second branch duct.

In yet another form the present application contemplates a combustor, comprising: a combustion chamber; an annular mixing duct; a fuel injector disposed in flow communication with the annular mixing duct, the fuel injector delivering a fuel into air flowing within the mixing duct to define a fuel and air mixture; and, at least two branch passages connected with the annular mixing duct, each of the at least two branch passages receiving a portion of the fuel and air mixture and delivering the respective portion of the fuel and air mixture to a distinct location within the combustion chamber separate from the other branch passages, wherein the delivery of the fuel and air mixture through each of the at least two branches is phased to prevent the occurrence of fuel air ratio fluctuations.

Objects and advantages of the present invention will be apparent from the following description of the preferred embodiments.

DESCRIPTION OF THE ILLUSTRATIVE EMBODIMENTS

Figure 1:
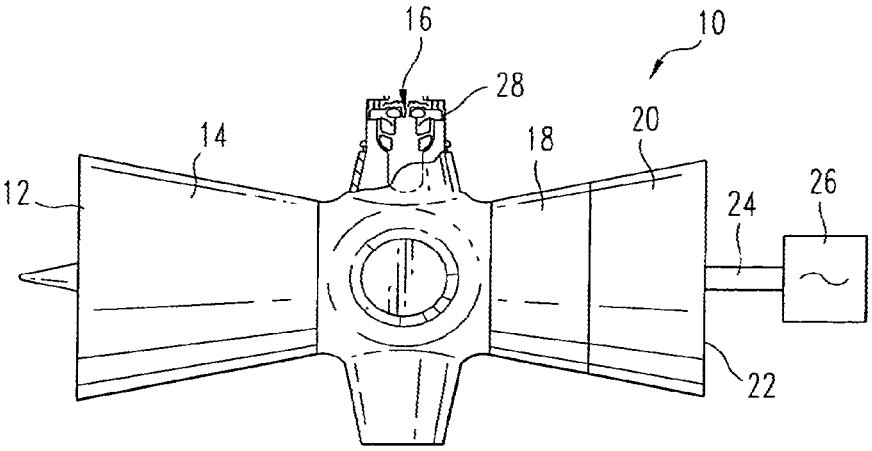
FIG. 1 is an illustrative view of a gas turbine engine having a combustor including one embodiment of a mixing duct of the present application.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention is illustrated therein being contemplated as would normally occur to one skilled in the art to which the invention relates.

Referring to FIG. 1, there is illustrated a generic representation of a gas turbine engine 10. In one form the gas turbine engine 10 is an industrial gas turbine engine including in axial flow series an inlet 12, a compressor section 14, a combustor section 16 including a plurality of combustion chamber devices 28, a turbine section 18, a power turbine section 20 and an exhaust 22. The turbine section 20 is arranged to drive the compressor section 14 via one or more shafts (not illustrated). The power turbine section 20 is arranged to provide drive for other purposes. In one form an electric generation device 26 is driven by a shaft 24 from the power turbine section 20. The operation of the gas turbine engine 10 is considered generally conventional and will not be discussed further.

Figure 2:
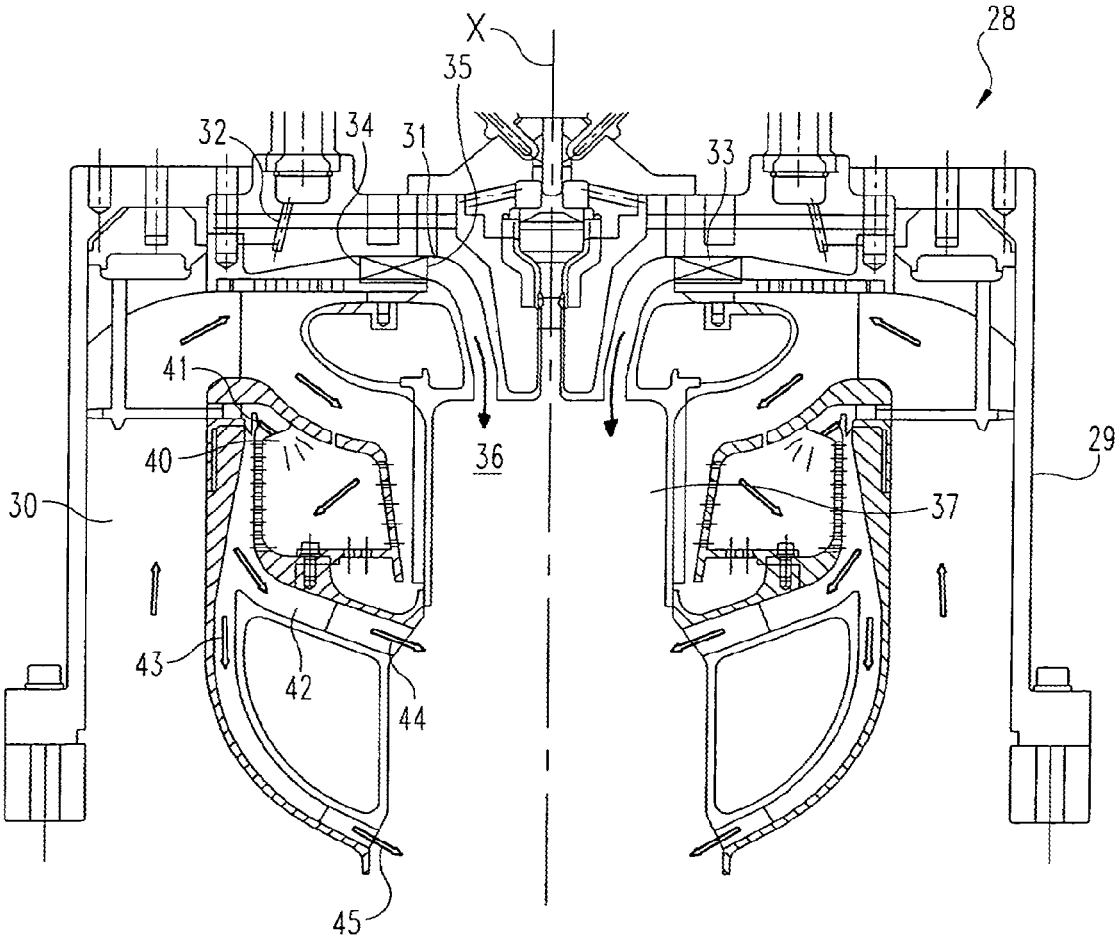
FIG. 2 is an enlarged illustrative sectional view of one embodiment of the combustor comprising a branched mixing duct of the present application.

With reference to FIG. 2, there is illustrated one embodiment of the combustion chamber device 28. In one form the gas turbine engine 10 is an industrial engine including a plurality of circumferentially spaced combustion chamber devices 28. A centerline 'X' of the combustion device 28 extends in one embodiment in a generally radial direction relative to the centerline of the engine 10. However, other orientations of the combustion chamber devices 28 are contemplated herein.

In FIG. 2, there is illustrated a sectional view of one embodiment of the combustion chamber device 28. The combustion chamber device 28 includes a mechanical housing/case 29. The mechanical housing/case 29 may be of a single piece or multi-piece configuration. Pressurized working fluid from the compressor 14 flows through an annular passageway 30 to a primary annular mixing duct 31. The primary annular mixing duct 31 includes a set of swirler vanes 33 to impart swirl to the fluid passing therethrough. In a preferred form of the present application the working fluid is ambient air, however other working fluids are contemplated herein. Fuel is delivered into the working fluid flow within the primary annular mixing duct 31 by a fuel delivery device 32. The present application contemplates an alternate embodiment wherein the introduction of fuel occurs after the working fluid flow passes through the set of swirler vanes 33. The fuel delivery device 32 is coupled to a fuel source. In one form the fuel delivery device includes a fuel injection nozzle to deliver a pressurized fuel to the working fluid flow. However, the present application contemplates a wide variety of fuel manifolds and systems for delivering fuel to the working fluid flow.

A set of swirler vanes 33 are located in an upstream portion of the primary annular mixing duct 31. The set of swirler vanes 33 receive the incoming flow of fluid at the swirler vane inlet 34 and discharge a swirling fluid flow at the swirler vane outlet 35. The swirling fluid flow exits the primary annular mixing duct 31 into the primary combustion zone 36 of the combustion chamber 37. A recirculation zone may be set up in order to help stabilize the combustion process. In one form of the present application the set of swirler vanes 33 are radial inflow swirler vanes that include a plurality of vanes and/or airfoils that turn the incoming fluid to impart swirl to the flow stream. However, other types of swirlers are contemplated herein.

A portion of the working fluid from the compressor 14 flows from annular passageway 30 to an annular fuel and working fluid mixing duct 40 formed around the centerline X of the combustion chamber 37. A fuel delivery device 41 is positioned to discharge fuel into working fluid passing through the annular duct 40. The fuel delivery device 41 is coupled to a fuel source. In one form the fuel delivery device 41 includes a fuel injection nozzle to deliver a pressurized fuel to the working fluid flow. However, the present application contemplates a wide variety of fuel manifolds and systems for delivering fuel to the working fluid flow.

The annular mixing duct 40 is separated into at least two separate and distinct branch ducts 42 and 43. The present application contemplates that in one form the fuel delivered into the at least two separate and distinct branch ducts is from a single fuel delivery device. However, other quantities of fuel delivery devices are contemplated herein.

Each of the branch ducts 42 and 43 are an annular duct defining a separate fluid flow passageway to the combustion chamber 37. The branch duct 42 directs a portion of the working fluid and fuel mixture from the annular mixing duct 40 through a discharge 44 into a first location within the combustion chamber 37. Branch duct 43 directs the remaining portion of the working fluid and fuel mixture from the annular mixing duct 40 through a discharge 45 into a second location within the combustion chamber 37. The discharge 45 from the branch duct 43 is located downstream from the discharge 44 of the branch duct 42. The time to deliver the working fluid and fuel mixture from the annular mixing duct 40 and through the branch duct 42 to the combustion chamber is different from the time to deliver the working fluid and fuel mixture from the annular duct 40 and through the branch duct 43 to the combustion chamber. In an alternate embodiment the present application contemplates that the annular mixing duct 40 is separated into three of more separate and distinct branch ducts that each deliver a portion of the fuel and working fluid mixture from the duct 40 to axially spaced locations within the combustion chamber 37.

Each of the branch ducts 42 and 43 define a fluid flow passageway free of fluid flow separations. In one form of the present application the working fluid and fuel accelerate through each of the branch ducts 42 and 43 until passing through the respective discharges 44 and 45. The branch ducts 42 and 43 are configured as converging ducts with a decreasing cross-sectional area from where the branch ducts separate from the annular mixing duct 40 to the discharges 44 and 45.

Figure 3:
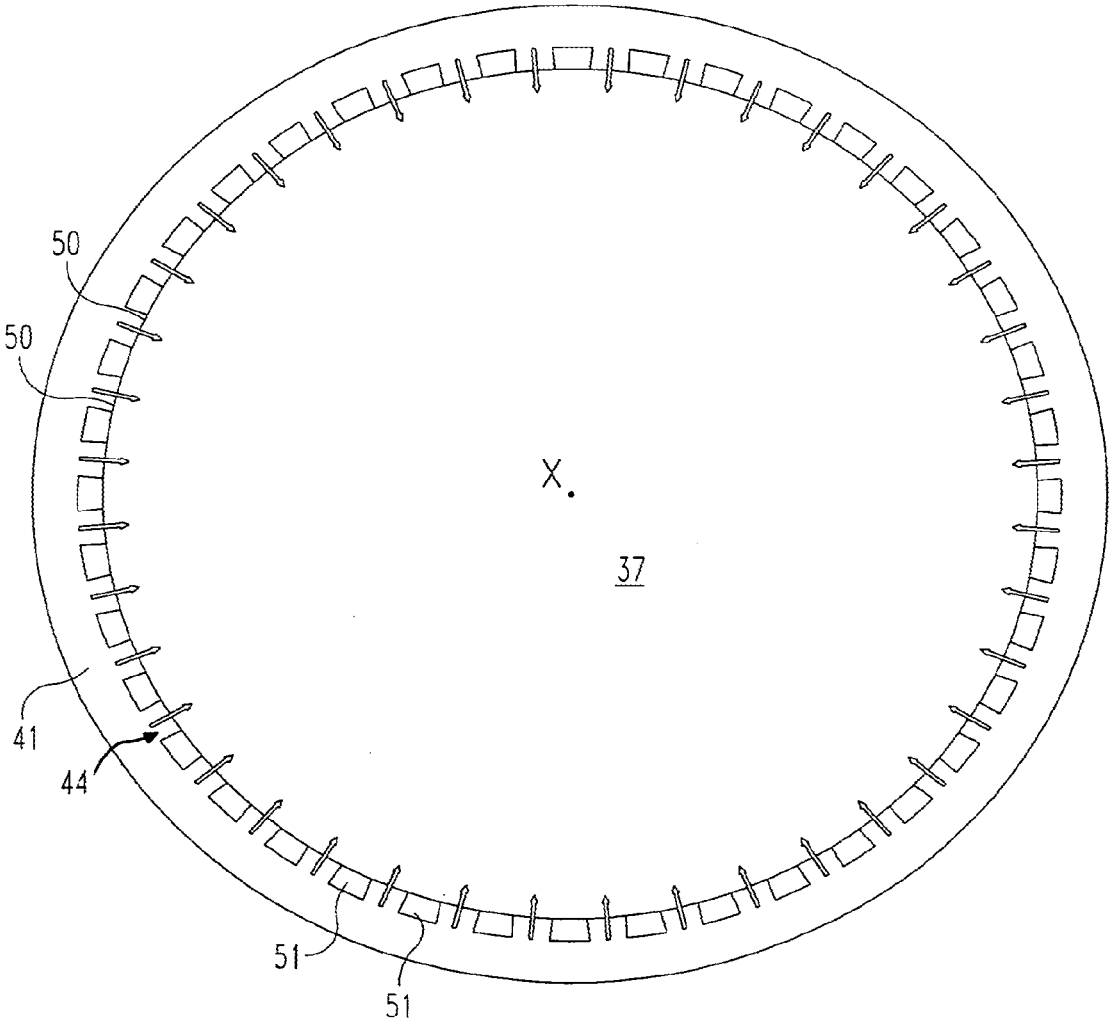
FIG. 3 is an illustrative sectional view of the discharge outlet from one of the branched mixing ducts into the combustion chamber.

With reference to FIG. 3, there is schematically illustrated the delivery of the fuel and working fluid mixture from branch duct 41 into the combustion chamber 37. In one form of the present application the branch discharge 44 is a circumferential discharge opening that has been divided into a plurality of discrete openings 50. The plurality of discrete openings 50 are circumferentially spaced around the combustion chamber 37. In one form the plurality of discrete openings 50 are formed by the location of a plurality of members 51 within the branch duct 41. The plurality of members 51 extending into the branch duct 41 and functioning to divide the fluid flow path prior to the fluid passing through the branch discharge 44. In one form the plurality of members 51 are wedges. The fuel and working fluid mixture will be discharged from the plurality of discrete openings 50 as discrete jets into the combustion chamber 37. A substantially similar means for dividing the working fluid and fuel delivered through discharge 45 of branch duct 43 is contemplated herein. Therefore, the present application contemplates that the fuel and working fluid mixture may be delivered into the combustion chamber 37 as discrete jets. However, the present application also contemplates that one or all of the branch ducts may be free of the plurality of members 51 and that the discharge is through an uninterrupted circumferential opening.

Figure 4:
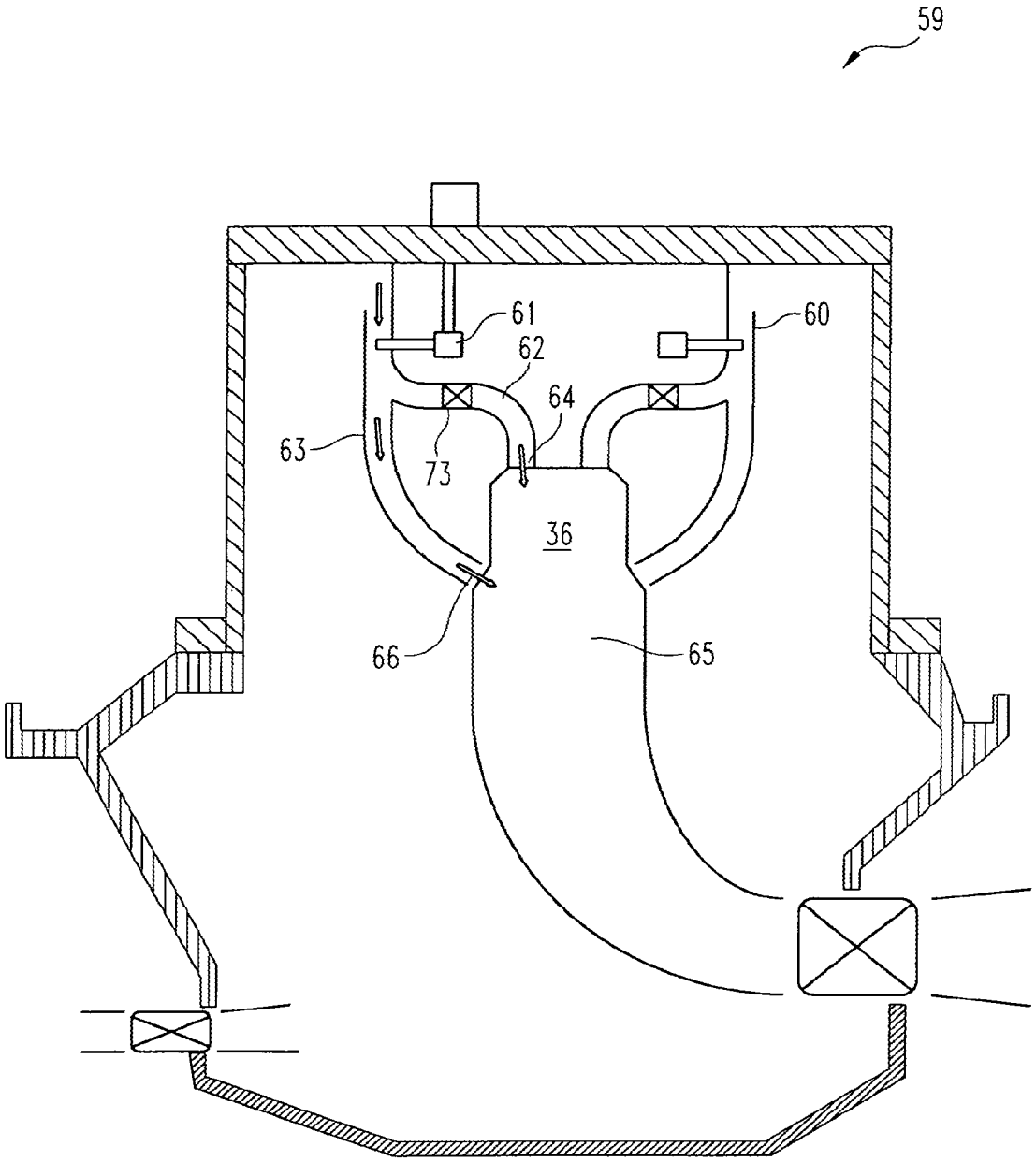
FIG. 4 is an illustrative sectional view of another embodiment of a combustor of the present application.

With reference to FIG. 4, there is illustrated another embodiment of the combustion chamber device 59 of the present application. Pressurized working fluid from the compressor 14 is introduced into an annular mixing duct 60. A fuel delivery device 61 is operable to deliver a fuel into the working fluid flowing through the annular mixing duct 60. The annular mixing duct 60 is separated into at least two separate and distinct branch ducts 62 and 63. Each of the branch ducts 62 and 63 are an annular duct defining a separate fluid flow passageway to the combustion chamber 65. The branch duct 62 directs a portion of the working fluid and fuel mixture from the annular mixing duct 60 through a discharge 64 into a first location within the combustion chamber 65. Branch duct 63 directs the remaining portion of the working fluid and fuel mixture from the annular mixing duct 60 through a discharge 66 into a second location within the combustion chamber 65. The discharge 66 from the branch duct 63 is located downstream from the discharge 64 of the branch duct 62.

In one form of the combustion chamber device 59 a set of swirler vanes 73 are located in an upstream portion of the branch duct 62. However, in another form of the present application the branch duct 62 is free of the set of swirler vanes. The set of swirler vanes 73 discharge a swirling fluid flow at the swirler vane outlet that passes through the discharge 64 into the combustion chamber 65. The swirling fluid flow exits the branch duct 62 into the primary combustion zone 36 of the combustion chamber 65. A recirculation zone may be set up in order to help stabilize the combustion process. In one form of the present application the set of swirler vanes 73 are radial inflow swirler vanes that include a plurality of vanes and/or airfoils that turn the incoming fluid to impart swirl to the flow stream.

The present application provides for the delivery of fuel into a working fluid flowing within a mixing duct. The pressure of the working fluid has been increased in the compressor section of the gas turbine engine. The mixing duct is separated into at least two separate and distinct branch ducts for the passage of the working fluid and fuel mixture to the combustor. The passage of the working fluid and fuel from the mixing duct into the branch ducts separates the fluid into separate and distinct streams of fuel and working fluid. Each of the separate and distinct branch ducts delivers the separate stream of fuel and working fluid to a distinct location within the combustion chamber. The separated streams of fuel and working fluid from the mixing duct pass through the separate branch ducts, with each duct defining a distinct travel and/or residence time before reaching the combustion chamber. Therefore, the time for fuel delivery until the time for combustion is separate and distinct for each of the separated streams. More specifically, there is a difference in the travel time and/or residence time (delay time) for the working fluid and fuel mixture between the separate and distinct branch ducts. This difference in delay time creates a phasing relationship that diminishes and/or eliminates the occurrence of fuel and working fluid ratio fluctuations. In one form of the present application the difference in delay time between the separate branches is selected to maximize the attenuation of combustor pulsations that originate from the burning zone within the combustion chamber.

Figure 5:
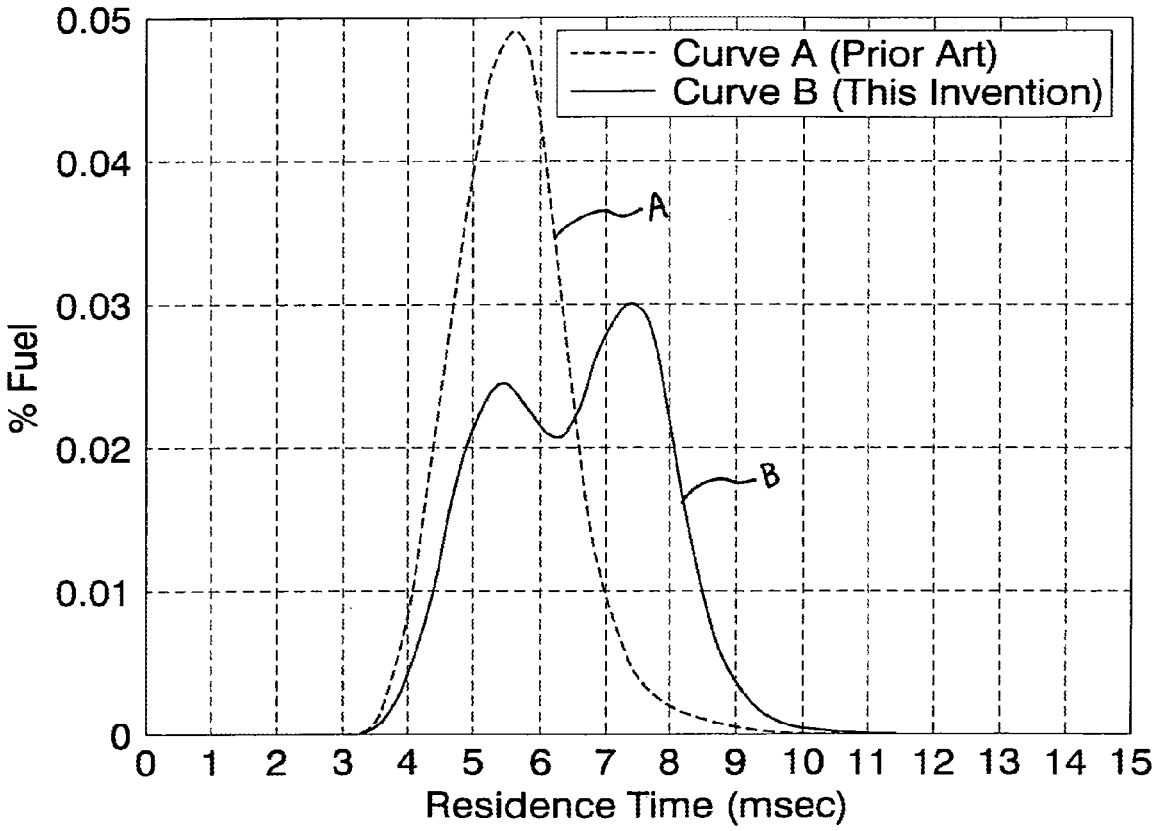
FIG. 5 is a graph illustrating the distribution of fuel residence time inside a fuel and air mixing duct.

With reference to FIG. 5, there is illustrated a curve depicting the distribution of fuel residence time inside a fuel and air mixing duct, comparing one form of the present invention (curve B) to prior devices (curve A). The prior devices are disclosed in commonly owned U.S. Pat. Nos. 6,698,206 and 6,732,527. The prior devices distribution of fuel residence time is a single-peaked exponential distribution of fuel residence time, as shown by curve A in FIG. 5. In the present inventions utilizing a two branch mixing duct the distribution of fuel residence time, results in a double-peaked distribution, as shown by curve B in FIG. 5. The separation between the two peaks of curve B in FIG. 5 corresponds to the difference in travel time between the two branches. As disclosed in the above referenced prior patents and scientific publications (ASME paper GT2004-53767), the attenuation of FAR oscillations can be computed from the knowledge of the residence time distributions of FIG. 5.

Figure 6:
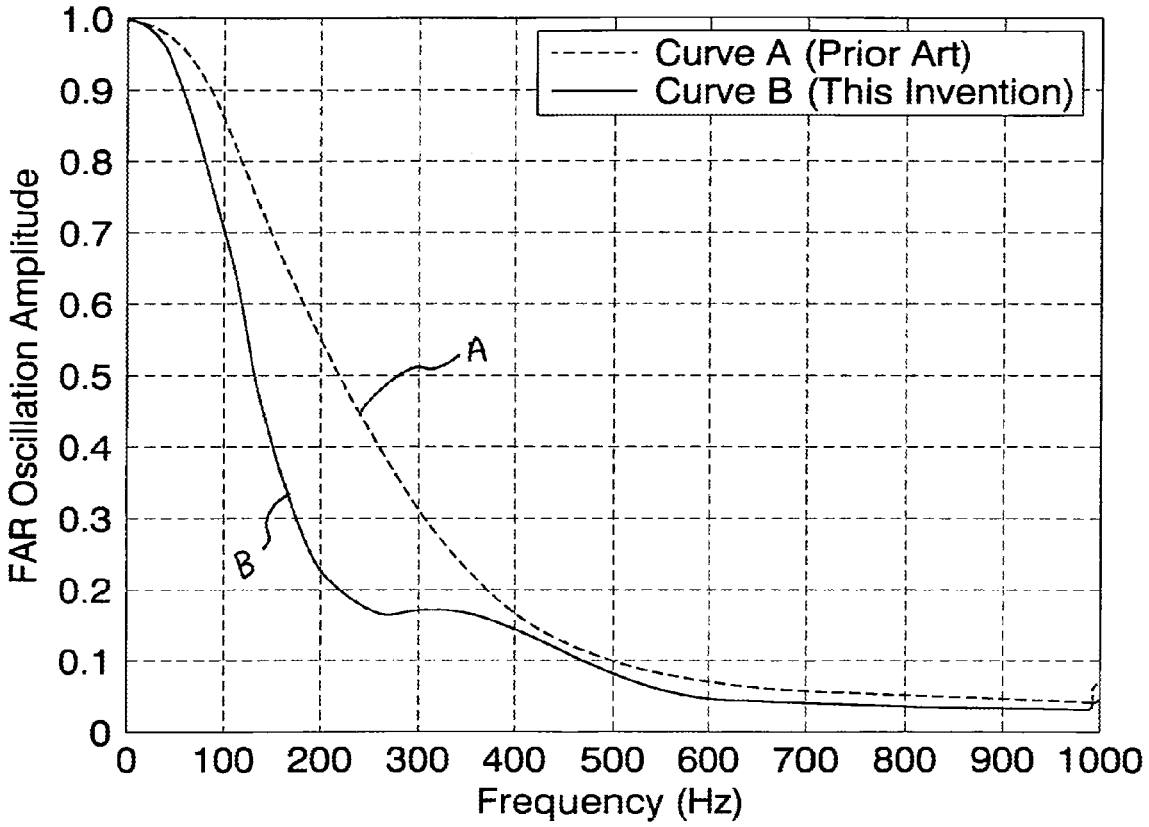
FIG. 6 is a graph illustrating the attenuation of FAR oscillations.

The attenuation of FAR oscillations is shown in FIG. 6. The curve labeled as "A" in FIG. 6 refers to the prior devices as previously disclosed in U.S. Pat. Nos. 6,698,206 and 6,732,527. The curve labeled as "B" represents one form of the present invention utilizing a two branch mixing duct. In one form the two-branch mixing duct configuration provides increased attenuation between about 200 Hz and 300 Hz. Frequencies in the vicinity of about 250 Hz may correspond to the lowest acoustic mode of the combustor. In one form of the present invention the time delay difference between the branches was selected so as to maximize the effect at the vicinity of this frequency.

Figure 7:
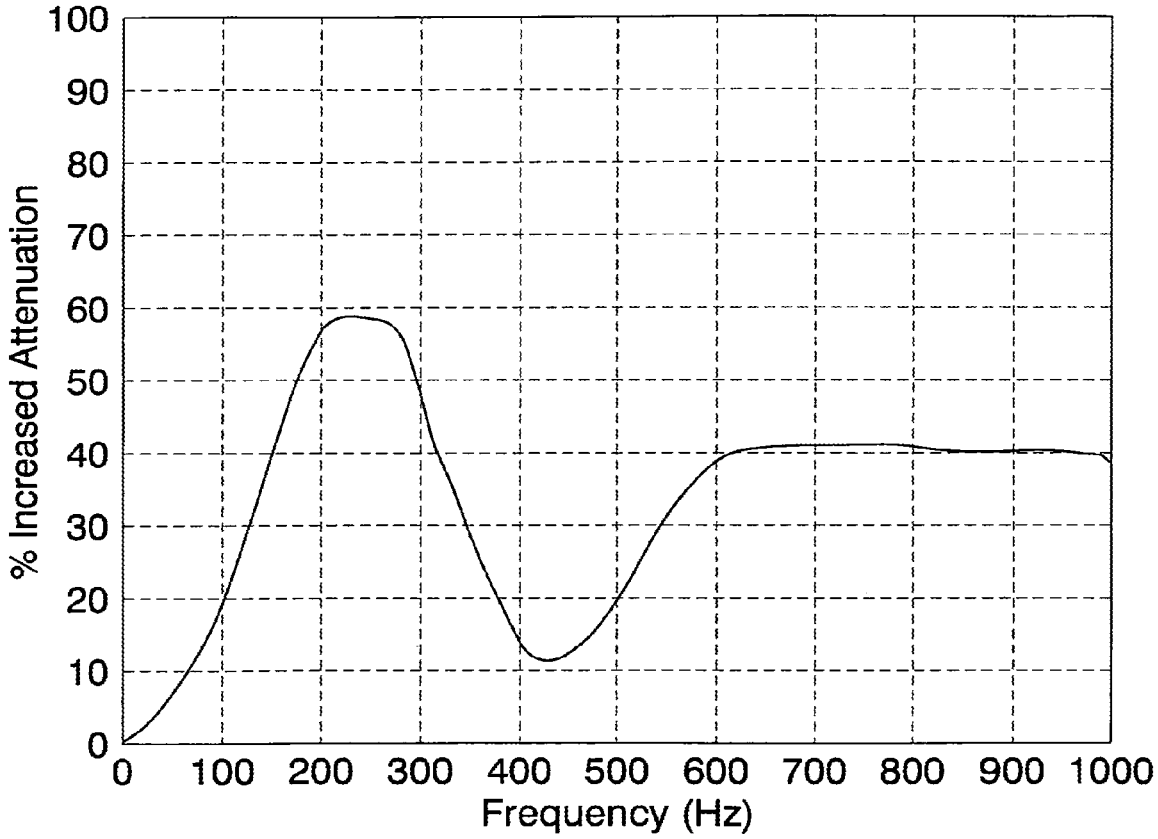
FIG. 7 is a graph illustrating the improved attenuation or damping resulting from one form of the present invention as compared to the prior devices.

With reference to FIG. 7, there is illustrated a plot of the improved attenuation or damping resulting from the present invention, compared to the prior devices. In one form the present invention gives an improvement of about 60% in the damping performance of the fuel and air mixer, in the frequency range from about 200 Hz to 300 Hz. Furthermore, in one form the present invention shows a 40% improvement in damping for frequencies that are in excess of 600 Hz.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. All patents and publications listed herein are incorporated in the entirety by reference.

What is claimed is:

1. A method comprising:

increasing the pressure of a working fluid within a compressor of a gas turbine engine;

communicating the working fluid from the compressor toward a combustion chamber via an annular passage that surrounds the combustion chamber;

introducing a fuel into the working fluid after said increasing to define a fuel and working fluid mixture;

separating the fuel and working fluid mixture into at least two distinct and separate fuel and working fluid mixture streams; and delivering one of the at least two distinct and separate fuel and working fluid mixture streams to a first location within the combustion chamber and an other of the at least two distinct and separate fuel and working fluid mixture streams to a second location within the combustion chamber via an annular shaped branch duct disposed radially inward of the annular passage and radially outward of the combustion chamber with respect to a centerline of the combustion chamber, wherein the time to deliver the fuel and working fluid mixture stream to the first location is different than the time to deliver the fuel and working fluid mixture stream to the second location, and wherein the difference in time to deliver the fuel and working fluid mixture streams to the combustion chamber is selected to maximize attenuation of combustor pulsations within the combustion chamber.

2. The method of claim 1, wherein the branch duct comprises a decreasing cross-sectional area that is effective to accelerate the other of the at least two distinct and separate fuel and working fluid mixture streams.

3. The method of claim 1, wherein in said delivering each of the fuel and working fluid mixture streams are introduced into the combustion chamber as a plurality of jets.

4. The method of claim 1, wherein in said introducing the fuel is discharged from a single fueling device.

5. The method of claim 1, wherein the branch duct comprises a decreasing cross-sectional area that is effective to accelerate the other of the at least two distinct and separate fuel and working fluid mixture streams;

wherein in said delivering each of the fuel and working fluid mixture streams are introduced into the combustion chamber as a plurality of jets.

6. A gas turbine engine combustor, comprising:

a combustion chamber;

a mixing duct configured to convey a working fluid therein;

an annular passage leading to the mixing duct and configured to convey the working fluid;

a fuel delivery device in fluid communication with said mixing duct, said fuel delivery device introduces a fuel to the working fluid within said mixing duct to define a fuel and working fluid mixture;

a first branch duct routing a first portion of the fuel and working fluid mixture from said mixing duct to a first location at said combustion chamber; and a second branch duct routing a second portion of the fuel and working fluid mixture from said mixing duct to a second location at said combustion chamber;

wherein the first branch duct and the second branch duct each comprise an annular shape and both are located radially between and axially aligned with the annular passage and the combustion chamber with respect to a centerline of the combustion chamber;

wherein the first and second branch ducts are configured such that the travel time of the first portion of the fuel and working fluid mixture to said first location is different from the travel time of the second portion of the fuel and working fluid mixture to said second location, and wherein the difference in travel time between the first portion of the fuel and working fluid mixture and the second portion of the fuel and working fluid mixture to the combustion chamber is selected to maximize attenuation of combustor pulsations within the combustion chamber.

7. The combustor of claim 6, wherein said mixing duct forms an annular fluid flow passage.

8. The combustor of claim 6, wherein each of said branch ducts comprises a decreasing cross-sectional area that is effective to accelerate their respective portion of the fuel and working fluid mixture flowing therethrough.

9. The combustor of claim 6, wherein each of said branch ducts includes an exit, and wherein said exit is divided into a plurality of spaced openings.

10. The combustor of claim 6, wherein said fuel delivery device is a fuel injecting device, and wherein all the fuel introduced into the working fluid within said mixing duct is from said fuel injecting device.

11. The combustor of claim 6, wherein said first branch duct has a first outlet and said second branch duct has a second outlet, and wherein one of the first or second outlets is downstream of the other of the first or second outlets.

12. The combustor of claim 6, wherein said mixing duct forms an annular fluid flow passage;

wherein each of said branch ducts comprises a decreasing cross-sectional area that is effective to accelerate a respective portion of the fuel and working fluid mixture flowing therethrough;

wherein each of said branch ducts includes an exit, and wherein each of said exits is divided into a plurality of circumferentially spaced openings; and wherein said first branch duct has a first outlet and said second branch duct has a second outlet, and wherein one of the first or second outlets is downstream of the other of the first or second outlets.

13. A gas turbine engine combustor for burning a fuel and air mixture, comprising:

a combustion chamber;

a first mixing duct;

an annular passage leading to the first mixing duct;

a first fuel delivery device in fluid communication with said first mixing duct, said first fuel delivery device introduces fuel to the air within said first mixing duct to define a first fuel and air mixture;

a second mixing duct with working fluid therein, said second mixing duct forming an annular passage around at least a portion of said combustion chamber;

a second fuel delivery device in fluid communication with said second mixing duct, said second fuel delivery device introduces fuel to the air within said second mixing duct to define a second fuel and air mixture;

a first branch duct in flow communication with said second mixing duct, said first branch duct receiving and routing a portion of the second fuel and air mixture to a first location at said combustion chamber; and a second branch duct in flow communication with said second mixing duct, said second branch duct receiving and routing another portion of the second fuel and air mixture to a second location at said combustion chamber, said second location is spaced downstream from said first location;

wherein the first branch duct and the second branch duct each comprise an annular shape and both are located radially between and axially aligned with the annular passage and the combustion chamber with respect to a centerline of the combustion chamber; and wherein the first and second branch ducts are configured such that the residence time of the portion of the second fuel and air mixture within said first branch duct is not equal to the residence time of the another portion of the second fuel and air mixture within said second branch duct, and wherein the difference in residence times within said first branch duct and said second branch duct is selected to maximize attenuation of combustor pulsations within the combustion chamber.

14. The combustor of claim 13, which further includes a plurality of swirler vanes in fluid flow communication with said first mixing duct;

wherein said branch ducts each include an outlet, and wherein each branch duct comprises a decreasing cross-sectional area that that is effective to accelerate a respective portion of the fuel and air mixture flowing therethrough.

15. The combustor of claim 14, wherein one of said outlets is downstream from the other of said outlets; wherein each of said outlets is a circumferential outlet having a plurality of spaced discrete openings for the passage of the fuel and air mixture to said combustion chamber.

16. The combustor of claim 13, wherein the difference in residence time has been determined to attenuate combustor pulsations originating from a burning zone within the combustion chamber.

17. A combustor, comprising:

a combustion chamber;

an annular mixing duct;

an annular passage leading to the annular mixing duct;

a fuel injector disposed in flow communication with said annular mixing duct, said fuel injector delivering a fuel into air flowing within said mixing duct to define a fuel and air mixture; and at least two branch passages connected with said annular mixing duct, each of said at least two branch passages receiving a portion of the fuel and air mixture and delivering their respective portion of the fuel and air mixture to a distinct location within said combustion chamber separate from the other branch passages, wherein each of said at least two branch passages comprises an annular shape and both are located radially between and axially aligned with the annular passage and the combustion chamber with respect to a centerline of the combustion chamber; and wherein each of said at least two branch passages are configured such that the delivery of the fuel and air mixture through each of said at least two branch passages is phased to prevent the occurrence of fuel air ratio fluctuations, and wherein a difference in travel time between the respective portions of the fuel and air mixture within each of said at least two branch passages to the combustion chamber is selected to maximize attenuation of combustor pulsations within the combustion chamber.

18. The combustor of claim 17, wherein each of said at least two branch passages comprises a decreasing cross-sectional area that that is effective to accelerate a respective portion of the fuel and air mixture flowing therethrough; and which further includes a second mixing duct with a plurality of swirler vanes, wherein said plurality of swirler vanes impart swirl to a fuel and air mixture discharged into a primary combustion zone within the combustion chamber.

* * * * *